US006251554B1

(12) United States Patent
Hoffend et al.

(10) Patent No.: US 6,251,554 B1
(45) Date of Patent: Jun. 26, 2001

(54) COATED CARRIER

(75) Inventors: Thomas R. Hoffend, Webster; Robert D. Bayley, Fairport; Carol A. Fox, Canandaigua; John G. VanDusen, Walworth; Scott M. Silence, Fairport; K. Derek Henderson, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/538,076

(22) Filed: Mar. 29, 2000

(51) Int. Cl.[7] ..... G03G 9/107; G03G 9/113
(52) U.S. Cl. ..... 430/106.2; 430/111.35
(58) Field of Search ..... 430/106.6, 108, 430/106.2, 111.35

(56) References Cited

U.S. PATENT DOCUMENTS

| | | | | |
|---|---|---|---|---|
| 3,533,835 | | 10/1970 | Hagenbach et al. | 117/217 |
| 3,590,000 | | 6/1971 | Palermiti et al. | 252/62.1 |
| 3,658,500 | | 4/1972 | Hagenbach | 65/21 |
| 3,798,167 | | 3/1974 | Kukla et al. | 252/62.1 |
| 3,918,968 | | 11/1975 | Kukla et al. | 96/1.5 D |
| 3,922,382 | | 11/1975 | Kukla et al. | 427/58 |
| 3,939,086 | | 2/1976 | Hagenbach | 252/62.1 P |
| 4,233,387 | | 11/1980 | Mammino et al. | 430/137 |
| 4,238,558 | | 12/1980 | Ziolo | 430/108 |
| 4,264,697 | | 4/1981 | Perez et al. | 430/107 |
| 4,310,611 | | 1/1982 | Miskinis | 430/107 |
| 4,397,935 | | 8/1983 | Ciccarelli et al. | 430/110 |
| 4,434,220 | | 2/1984 | Abbott et al. | 430/108 |
| 4,600,677 | * | 7/1986 | Hoffend et al. | 430/108 |
| 4,810,611 | | 3/1989 | Ziolo et al. | 430/106.6 |
| 4,906,547 | * | 3/1990 | Tavernier et al. | 430/108 |
| 4,935,326 | | 6/1990 | Creatura et al. | 430/108 |
| 4,937,166 | | 6/1990 | Creatura et al. | 430/108 |
| 5,935,750 | | 8/1999 | Barbetta et al. | 430/106.6 |
| 5,945,244 | | 8/1999 | Barbetta et al. | 430/106.6 |
| 6,004,712 | | 12/1999 | Barbetta et al. | 430/108 |
| 6,010,812 | | 1/2000 | Barbetta et al. | 430/106.6 |
| 6,025,104 | * | 2/2000 | Fuller et al. | 430/108 |

* cited by examiner

*Primary Examiner*—John Goodrow
(74) *Attorney, Agent, or Firm*—E. O. Palazzo

(57) ABSTRACT

A carrier comprised of a core and thereover a polymer generated from (1) a polymer containing amine groups, and (2) a second polymer containing sulfonic functional groups.

42 Claims, No Drawings

COATED CARRIER

PENDING APPLICATIONS AND PATENTS

Illustrated in U.S. Pat. No. 5,945,244; U.S. Pat. No. 5,935,750; U.S. Pat. No. 6,010,812; and U.S. Pat. No. 6,004,712, and U.S. Pat. No. 6,042,981; the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; U.S. Pat. No. 6,042,981 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,010,812 a carrier comprised of a core and a polymer coating of (1) styrene/monoalkylaminoalkyl methacrylate or (2) styrene/dialkylaminoalkyl methacrylate; in U.S. Pat. No. 5,935,750 a carrier comprised of a core and a polymer coating containing a quaternary ammonium salt functionality; and in U.S. Pat. No. 6,004,712 a carrier comprised of a core and thereover a polymer of (1) methylmethacrylate and a monoalkyl aminoalkyl methacrylate, or (2) a polymer of methylmethacrylate and dialkylaminoalkyl methacrylate.

Illustrated in U.S. Pat. No. 6,132,917, the disclosure of which is totally incorporated herein by reference, is a carrier comprised of a core and thereover a polymer generated from a polymer containing amine groups and a second polymer containing sulfonic acid functional groups.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, solution and preferably by dry powder processes. More specifically, the present invention relates to compositions, especially carrier compositions comprised of a core, and thereover a polymer, or polymers with amine, such as a number of the amines of the above copending applications and patents, and a second polymer containing a carboxylic acid functionality, or a sulfonic acid functionality.

In embodiments of the present invention, the carrier particles are comprised of a core with a coating thereover of a polymer or polymers generated from a mixture, or blend of an amine, such as dimethylaminoethyl methacrylate, substituted alkyl aminoethyl methacrylate, butylaminoethyl methacrylate, and the like, and a second polymer containing a carboxylic acid functionality, or a sulfonic acid functionality. The carrier may include the polymer coating thereover in admixture with other suitable polymers, and more specifically, with a polymer, such as a fluoropolymer, polymethylmethacrylate, poly(urethane), especially a crosslinked polyurethane, such as a poly(urethane) polyester and the like, and moreover, the copolymer coating may contain a conductive component, such as carbon black, and which conductive component is preferably dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ $(\text{ohm-cm})^{-1}$, and the like. An important advantage associated with the carriers of the present invention with a second polymer containing a carboxylic acid functionality, or a sulfonic acid functionality polymer thereover include the enablement of a crosslinked polymer, which crosslinking permits, for example, robust, extended life carriers with lifetimes, for example, of 1,000,000 imaging cycles, a high triboelectrical charge, for example a carrier tribo range of from about a plus (positive charge) 30 to about 100 microcoulombs per gram, and preferably from about a positive 40 to about a positive 70 microcoulombs per gram, and most preferably from about a positive 35 to about a positive 60 microcoulombs per gram. The carrier particles of the present invention can be selected for a number of different imaging systems and devices, such as xerographic copiers and printers, inclusive of high speed color xerographic systems, printers, digital systems, such as the Xerox Corporation Document Center 240/265, 5090, DocuTech Production Publisher, Model 135, 5775, 5100, a combination of xerographic and digital systems, and wherein colored images with excellent and substantially no background deposits are achievable.

Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low unstable triboelectrical values.

There are illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof. The present invention advantage in embodiments over this prior art is, for example, achieving high stable positive triboelectric charge on the carrier particles, that is high, up to about a 100 negative triboelectric charge is imparted to the toner particles developed onto a photoreceptor in, for example, a xerographic development environment. Further, the full range of electrical properties of the carrier particles can be achieved at high triboelectric charging values, from carrier conductivities of $10^{-17}$ mho/cm to $10^{-6}$ mho/cm, that is, from the insulative to the conductive regime, and the carrier triboelectric charge and carrier conductivity can be varied and preselected.

With further reference to the prior art, carriers obtained by applying insulating resinous coatings to porous metallic carrier cores using solution coating techniques are undesirable from many viewpoints. For example, the coating can reside primarily in some of the pores of the carrier cores, rather than at the surfaces thereof; and therefore, it is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome or minimize these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent necessarily on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$ and high carrier triboelectric charging values of from about 20 to about 100, and, for example, from a positive about 35 to a positive about 70 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles.

Other U.S. Patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values of at least about 35 microcoulombs per gram, and wherein the carrier includes thereover a coating of polymers wherein one of the polymers is a copolymer of methylmethacrylate, and an dialkylaminoalkyl methacrylate, and wherein the coating may contain therein a conductive component of, for example, carbon black.

Aspects of the present invention relate a carrier comprised of a core and thereover a polymer generated from a blend of a polymer containing amine groups and a second polymer containing carboxylic acid functional groups; a carrier wherein the amine polymer is generated from a monoalkyl aminoalkyl methacrylate, or a dialkylaminoalkyl methacrylate; a carrier wherein the methacrylate is 2-dimethylaminoethyl methacrylate, 2-diethylaminoethyl methacrylate, 2-diisopropylaminoethyl methacrylate, or 2-butylaminoethyl methacrylate; a carrier wherein the second polymer is generated from acrylic acid, methacrylic acid, crotonic acid, maleic acid, or itaconic acid; a carrier wherein each of the alkyls independently contains from 1 to about 25 carbon atoms, and the polymer is optionally comprised of polymers; a carrier wherein each of the alkyls independently contains from 1 to about 6 carbon atoms; a carrier wherein the polymer generated is a crosslinked polymer of an amine polymer containing dialkylaminoalkyl methacrylate and a carboxylic acid polymer of dialkyl amino alkyl methacrylates; a carrier wherein the second polymer containing carboxylic acid functional groups acid is generated from acrylic acid, methacrylic acid, crotonic acid, maleic acid, or itaconic acid; a carrier wherein there results a copolymer that contains from about 60 to 95 weight percent of the amine polymer and from about 5 to 40 weight percent of the second polymer; a carrier wherein the polymer generated possesses an $M_w$, weight average molecular weight, of from about 10,000 to about 900,000, and of an $M_n$ of from about 4,000 to about 350,000; a carrier wherein the polymer generated is a blend of polymers and the coating weight thereof is from about 0.1 to about 20 weight percent; a carrier wherein the polymer thereover coating weight is from about 1 to about 3 weight percent; a carrier wherein the polymer generated contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a carrier with a triboelectric charge of from about a positive 35 to about a positive 100 microcoulombs per gram; a carrier with a triboelectric charge of from about a positive 40 to about a positive 70 microcoulombs per gram; a developer comprised of the carrier illustrated herein and toner; a developer wherein the toner is comprised of thermoplastic resin and colorant; a developer wherein the colorant is a pigment and the resin is a styrene copolymer, or a polyester; a developer comprised of a (1) carrier core and coating layer of a polymer, or polymers generated from a mixture of an amine containing polymer and a second polymer containing a carboxylic acid functional group or groups, and (2) a toner; a developer wherein the carrier core is selected from the group consisting of iron, ferrites, steel and nickel; a developer with a carrier triboelectric charge of from about a positive 40 to about a positive 70 microcoulombs per gram, and a toner triboelectric charge of from about a negative 40 to about a negative 70 microcoulombs per gram; a carrier wherein the polymer is a copolymer generated from the reaction of the amine and the acid functional groups of the second acid containing polymer; a carrier wherein the copolymer is polymethyl methacrylate-co-dimethyl aminoethyl methacrylate; polymethyl methacrylate-co-methacrylic acid; polymethyl methacrylate-co-dimethyl aminoethyl methacrylate and polymethyl methacrylate-co-ethylene sulfonic acid; polymethyl methacrylate-co-dimethyl aminoethyl methacrylate and polymethyl methacrylate-co-2-sulfoethyl methacrylate; polymethyl methacrylate-co-dimethyl aminoethyl methacrylate and polymethyl methacrylate-co-styrene sulfonic acid; polymethyl methacrylate-co-dimethyl aminoethyl methacrylate and polymethyl methacrylate-co-2-acrylamido-2-methyl-1-propanesulfonic acid; polymethyl methacrylate-co-2-diisopropylaminoethyl methacrylate and polymethyl methacrylate-co-2-sulfoethyl methacrylate; and polystyrene-co-dimethyl aminoethyl methacrylate and polymethyl methacrylate-co-2-sulfoethyl methacrylate; a carrier wherein the carboxylic acid containing polymer is selected in the amount of about 65 to about 5 weight percent of the total weight of the amine containing polymer and the acid containing polymer; the $M_w$ of the resulting amine and acid containing polymers are in the range of about 15,000 to about 500,000 and the $M_n$ values for the amine and acid containing polymers is in the range of from about 7,000 to about 220,000; a carrier wherein the carrier contains an additional polymer coating; a carrier wherein the additional coating is comprised of a styrene acrylate, a styrene methacrylate, methyl methacrylate or a fluoropolymer; a carrier wherein the additional coating is comprised of a polyurethane and which polyurethane optionally contains dispersed therein a conductive component or conductive components; a carrier wherein the additional coating is comprised of a polyurethane/polyester with carbon black optionally dispersed therein; a carrier wherein the substituted alkyl aminoethyl methacrylate is 2-tertiarybutylaminoethyl methacrylate, or dimethylaminoethyl methacrylate (TRH); an imaging process which comprises developing an image with the developer illustrated herein; a process for the preparation of the carrier illustrated herein by the dry mixing and heating of the core and the generated polymer coating; a carrier comprised of a core and thereover a polymer coating generated from of an amine containing polymer and a second acid containing polymer; a carrier wherein the polymer coating is crosslinked; a carrier wherein the amine polymer is polymethyl methacrylate-co-dimethylaminoethyl methacrylate; a carrier comprised of a core and thereover a polymer generated from the reaction of a polymer containing amine groups and a second polymer containing a carboxylic acid functionality; and an optional additional polymer of a polyurethane/polyester; a carrier wherein the core is a strontium ferrite; a developer with a carrier triboelectric charge of from about a positive 30 to about a positive 100 microcoulombs per gram, and a toner triboelectric charge of from about a negative 30 to about a negative 100 microcoulombs per gram; a carrier comprised of a core and a polymer coating, and wherein the coating is comprised of the reaction product of an amine containing polymer and an acid containing polymer; a carrier wherein the acid polymer is a polymer containing carboxylic acid function groups; a developer comprised of the carrier illustrated hereinbefore, and toner; a developer wherein the core contains an additional third or fourth polymer coating; a carrier comprised of a core and thereover a polymer generated from (1) a polymer containing amine groups, and (2) a second polymer containing sulfonic functional groups; a carrier wherein the amine polymer is generated from a monoalkylamino methacrylate or a dialkylaminoalkyl methacrylate; a carrier wherein each of the alkyls contain from 1 to about 25 carbon atoms; a carrier wherein each of the alkyls contain from 1 to about 7 carbon atoms; a carrier wherein the methacrylate is a dialkylaminoalkyl methacrylate; a carrier wherein the methacrylate is 2-dimethylaminoethyl methacrylate, 2-diethylaminoethyl methacrylate, 2-diisopropyl-aminoethyl methacrylate, or 2-tertiary butylaminoethyl methacrylate; a carrier wherein the second polymer is generated from alkylene sulfonic acid, styrene sulfonic acid, sulfoalkyl methacrylate, or acrylamidoalkylpropane sulfonic acid; a carrier wherein the second polymer is generated from ethylene sulfonic acid, 2-sulfoethyl methacrylate, or 2-acrylamindo-2-methyl 1-propanesulfonic acid; a carrier wherein there is generated a blend of the amine polymer and the second polymer, and wherein there results from the blend a crosslinked polymer; a carrier wherein there is generated a polymer containing from about 60 to about 95 percent of the amine polymer, and from about 5 to about 40 percent by weight of the second polymer; a carrier wherein the generated polymer possesses an $M_w$ of from about 10,000 to about 900,000, and of an $M_n$ of from about 4,000 to about 350,000; a carrier wherein the generated polymer is a blend of polymers, and the coating weight thereof is from about 0.1 to about 20 weight percent; a carrier wherein the generated polymer coating weight is from about 1 to about 3 weight percent; a carrier wherein the generated polymer contains a conductive component; a carrier wherein the conductive component is carbon black; a carrier wherein the conductive component is carbon black selected in an amount of from about 10 to about 60 weight percent; a carrier wherein the core is a metal, a metal oxide, or a ferrite; a carrier with a triboelectric charge of from about a positive 35 to about a positive 100 microcoulombs per gram; a developer comprised of the carrier of the present invention and toner; a developer wherein the toner is comprised of thermoplastic resin and colorant; a developer wherein the colorant is a pigment, and the resin is a styrene copolymer or a polyester; a developer comprised of a (1) carrier core, and thereover a coating of a polymer or polymers generated from a mixture of an amine polymer and a second polymer containing sulfonic acid functional groups, or a sulfonic acid functional group; a developer wherein the carrier core is selected from the group consisting of iron, ferrites, steel and nickel; a developer with a carrier triboelectric charge of from about a positive 30 to about a positive 100 microcoulombs per gram, and a toner triboelectric charge of from about a negative 30 to about a negative 100 microcoulombs per gram; a carrier wherein the generated polymer is a copolymer generated from the reaction of the amine polymer and the second polymer; a carrier wherein the copolymer is polymethyl methacrylate-co-dimethyl aminoethyl methacrylate and polymethyl methacrylate-co-ethylene sulfonic acid; polymethyl methacrylate-co-dimethyl aminoethyl methacrylate and polymethyl methacrylate-co-2-sulfoethyl methacrylate; polymethyl methacrylate-co-dimethyl aminoethyl methacrylate and polymethyl methacrylate-co-styrene sulfonic acid; polymethyl methacrylate-co-dimethyl aminoethyl methacrylate and polymethyl methacrylate-co-2-acrylamido-2-methyl-1-propanesulfonic acid; polymethyl methacrylate-co-2-diisopropylaminoethyl methacrylate and polymethyl methacrylate-co-2-sulfoethyl methacrylate; and polystyrene-co-dimethyl aminoethyl methacrylate and polymethyl methacrylate-co-2-sulfoethyl methacrylate; a carrier wherein the generated polymer coating possesses an $M_w$, of from about 15,000 to about 500,000 and an $M_n$ of from about 7,000 to about 225,000, the polymer coating resulting from the amine polymer and the second polymer; a carrier wherein the carrier contains an additional polymer coating; a carrier wherein the additional coating is comprised of a styrene acrylate, a styrene methacrylate, methyl methacrylate or a fluoropolymer; a carrier wherein the additional coating is comprised of a polyurethane, and which polyurethane optionally contains dispersed therein conductive components; a carrier wherein the additional coating is comprised of a polyurethane/polyester with carbon black optionally dispersed therein; a carrier wherein the substituted alkyl aminoethyl methacrylate is 2-tertiarybutylaminoethyl methacrylate, or dimethylaminoethyl methacrylate (TRH); an imaging process which comprises developing an image with the developer of the claimed invention; a process for the preparation of the carrier by the dry mixing and heating of the core and the generated polymer coating; a carrier comprised of a core and a (1) polymer coating, which coating is formed from an amine containing polymer and a polymer containing a sulfonic acid functionality; and (2) an optional additional polymer of a polyurethane/polyester; a carrier wherein the (1) polymer is formed by the reaction of the amine and the sulfonic acid polymer; a carrier wherein the core is strontium ferrite; a carrier wherein the generated polymer is formed by the reaction of (1) and (2); a carrier wherein the reaction is accomplished by heating; a carrier comprised of a core and a coating thereover of a polymer comprised of the reaction product of an amine containing polymer and a sulfonic containing polymer; a carrier comprised of a core and thereover a mixture of polymers inclusive of crosslinked polymers generated from an amine containing polymer and a second polymer containing a carboxylic acid functionality, or a sulfonic acid functionality, and which amines can be a monoalkylaminoalkyl methacrylate, dialkylaminoalkyl methacrylate, and the like, and wherein the carboxylic acid functionality, or a sulfonic acid functionality of the second polymer may be, for example, acrylic acid, methacrylic acid, maleic acid, sulfoethyl methacrylate, styrene sulfonic acid, 2-acrylamido-2-methyl-1-propanesulfonic acid (AMPS) or ethylene sulfonic acid and the like, wherein each of the polymer alkyls independently contains, for example, from 1 to about 25 carbon atoms; a carrier wherein preferably each of the alkyls independently contains from 1 to about 6 carbon atoms; a carrier wherein the polymer coating is generated from a blend of a copolymer of dimethylaminoethyl methacrylate, and a second polymer containing a carboxylic acid functionality, or a sulfonic acid functionality; a carrier wherein the polymer coating contains from about 60 to 95 weight percent of dialkylaminoalkyl methacrylate copolymer and from about 5 to 40 weight percent of a second polymer containing a carboxylic acid functional component, or a sulfonic acid functional component; a carrier wherein the copolymer coating possesses an $M_w$ (weight average molecular weight) of from about 10,000 to about 900,000, and of an $M_n$ (number average molecular weight) of from about 4,000 to about 350,000; a carrier wherein the polymer coating thereover is a copolymer generated from an amino compound, such as vinyl polymers with primary, secondary, or tertiary amine groups, and a second polymer containing a carboxylic acid functionality, or a second polymer containing sulfonic acid functionality, and wherein the coating weight thereof is from about 0.1 to about 20 weight percent; a carrier wherein the polymer coating weight is preferably from about 1 to about 3 weight percent; a carrier wherein the polymer coating contains dispersed therein a conductive component; a carrier wherein the conductive component is a metal oxide, or is carbon black; a carrier wherein the conductive component is suitable conductive material, such as carbon black selected in an amount of, for example, from about 10 to about 60 weight percent; a carrier wherein the core is a metal, a metal oxide, or a ferrite; a carrier with a triboelectric charge of from about a positive 30 to about a positive 100 microcoulombs per gram; a carrier with a triboelectric charge of from about 40 to about 70 microcoulombs per gram; and most preferably from about a positive 35 to about a positive 60 microcoulombs per gram; a developer comprised of a coated carrier and toner composition; a developer wherein the toner is comprised of thermoplastic resin and colorant; a developer wherein the colorant is a pigment and the toner resin is a styrene copolymer, or a polyester; a developer comprised of a (1) carrier core and coating layer of a copolymer generated from a mixture of a polymer containing an amine and an a second polymer containing a carboxylic acid functionality, or a sulfonic acid functionality, and (2) a toner; a developer wherein the carrier core is selected from the group consisting of iron, ferrites, steel and nickel; a developer with a carrier triboelectric charge of from about a positive 40 to about a positive 90 microcoulombs per gram, and a toner triboelectric charge of from about a negative 40 to about a negative 90 microcoulombs per gram; a developer with a carrier triboelectric charge of from about a positive 40 to about a positive 70 microcoulombs per gram, and a toner triboelectric charge of from about a negative 40 to about a negative 70 microcoulombs per gram; a carrier wherein the polymer coating is generated from a polymer or polymers that contain an amine and a second polymer containing a carboxylic acid functional group, or a sulfonic acid functional group, and wherein the amines are, for example, tertiary-butylaminoethyl methacrylate, diisopropylaminoethyl methacrylate, diethylaminoethyl methacrylate, dimethylaminoethyl methacrylate; a carrier wherein the carrier contains in addition to the polymers formed by the blend of polymers illustrated herein, an additional polymer coating; a carrier wherein the additional coating is comprised of a suitable polymer, such as styrene acrylate, a styrene methacrylate, methyl methacrylate or a fluoropolymer; a carrier wherein the additional coating is comprised of a polyurethane and which polyurethane optionally contains dispersed therein conductive components; and a carrier wherein the additional coating is comprised of a polyurethane/polyester with carbon black optionally dispersed therein.

The present invention is directed to, for example, developer compositions comprised of toner particles, and carrier particles prepared, for example, by a powder coating process, and wherein the carrier particles are comprised of a core with certain coatings thereover; carrier particles prepared by mixing low density porous magnetic, or magnetically attractable metal core carrier particles with from, for example, between about 0.05 percent and about 3 percent by weight, based on the weight of the coated carrier particles, of certain polymers, and which polymers may optionally contain dispersed therein carbon black or a similar conductive component, until adherence occurs thereof to the carrier core by mechanical impaction or electrostatic attraction; heating the resulting mixture of carrier core particles and polymers to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 35 to about 200 microns in diameter.

Specifically, the present invention relates to a composition comprised of a core, and thereover a polymer coating formed from a blend reaction of an amine containing polymer, from about 35 to about 95 weight percent or parts, and a second polymer containing a carboxylic acid functionality, or a second polymer containing a sulfonic acid functionality, from about 65 to about 5 weight percent or parts, with either polymer component optionally containing a conductive component, such as a metal oxide, or a pigment like preferably carbon black, wherein the conductive component is selected, for example, in an amount of from about 10 to about 75 weight percent, and preferably from about 15 to about 50 weight percent, based on the sum of the blend of the amine polymer and the second polymer containing a carboxylic acid functionality, or a sulfonic acid functionality and conductive component; a carrier with a number of polymers thereover, one generated from a blend of an amine polymer and a second polymer containing a carboxylic acid functionality, or a sulfonic acid functionality, as illustrated herein and an additional polymer of, for example, a fluorocarbon, polymethylmethacrylate (PMMA), a thermosetting polymer, such as a thermosetting polyurethane, a polyester, a styrene based copolymer, or a second a nitrogen-containing copolymer, and wherein the first polymer is selected in an amount of from about 1 to about 100, or from about 10 to about 75 weight percent, based on the total weights of all polymers and conductive components present in the carrier and the additional polymer is selected in an amount of from about 99 to about 0, or from about 90 to about 25 weight percent, based on the total weights of all polymers and conductive components present in the carrier, and wherein the conductive component for either the first or second polymer is a metal oxide, or a pigment selected in an amount of from about 10 to about 50 weight percent; and wherein the carrier core is a metal, a ferrite, a metal oxide, and the like, inclusive of known carrier cores. Also, in embodiments there are provided carriers with coatings of crosslinked polymers containing an amine polymer and a second polymer containing carboxylic acid functional, or sulfonic acid functional groups, and a mixture of these copolymers crosslinked and another polymer, such as PMMA, a thermosetting polyurethane, and the like, inclusive of suitable known polymers.

Various suitable solid core carrier materials can be selected for the carriers and developers of the present invention. Characteristic core properties of importance include those that will enable the toner particles to acquire a positive charge or preferably a negative charge, and carrier cores that will permit desirable flow properties in the developer reservoir present in the imaging and printing apparatus. Also of importance with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide available from D. M. Steward Corporation or Powdertech Corporation, Ni/Zn-ferrite available from Powdertech Corporation, strontium ferrites, especially Sr (strontium)-ferrite, preferably containing, for example, about 14 percent strontium oxide and 86 percent iron oxide and available from Powdertech Corporation Ba-ferrite, magnetites available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, from about 50 to about 200 microns, and preferably from about 50 to about 50 microns.

Examples of carrier polymer coatings selected are primarily generated from components containing a blend of an amine polymer and a second polymer containing a carboxylic acid functionality, or a polymer containing a sulfonic acid functionality, wherein the amine polymers are, for example, a monoalkyl or dialkyl amine, such as a dimethylaminoethyl methacrylate, diethylaminoethyl methacrylate, diisopropylaminoethyl methacrylate, or t-butylaminoethyl methacrylate; and the like, with examples of a second polymer containing a carboxylic acid functionality, or a sulfonic acid functionality being, for example, a functionality of acrylic acid, methacrylic acid, crotonic acid, maleic acid, itaconic acid, ethylene sulfonic acid, styrene sulfonic acid, 2-acrylamido-2-methylpropane sulfonic acid (AMPS), 2-sulfoethyl methacrylate, and the like.

Specific examples of copolymers selected for generation of the carrier coatings are comprised of an amine polymer, such as polymethyl methacrylate-co-dimethylaminoethyl methacrylate; polymethyl methacrylate-co-diethylaminoethyl methacrylate; polymethyl methacrylate-co-diisopropylaminoethyl methacrylate; polymethyl methacrylate-co-t-butylaminoethyl methacrylate; polystyrene-co-dimethylaminoethyl methacrylate; polystyrene-co-diethylaminoethyl methacrylate; polystyrene-co-diisopropylaminoethyl methacrylate; polystyrene-co-t-butylaminoethyl methacrylate; and the like; carboxylic acid or sulfonic acid polymers, such as polymethyl methacrylate-co-acrylic acid; polymethyl methacrylate-co-methacrylic acid; polymethyl methacrylate-co-ethylene sulfonic acid; polymethyl methacrylate-co-2-sulfoethyl methacrylate; polymethyl methacrylate-co-styrene sulfonic acid; polymethyl methacrylate-co-2 acrylamido-2-methyl-1-propanesulfonic acid (AMPS); and the like, wherein the $M_w$, weight average molecular weight, values for the amine and acid containing polymers can be in the range of, for example, about 15,000 to about 500,000 and with $M_n$ values for the amine and acid containing polymers of, for example, in the range of about 7,000 to about 220,000, and wherein the polymer product coated on the carrier core possesses, for example, an $M_w$ of from about 20,000 to about 3,000,000 and an $M_n$ of from about 12,000 to about 3,000,000; and also wherein the mole percent of amine and acid groups in the amine and acid containing polymers can be in the range of, for example, about 0.1 to about 20 mole percent.

The carrier polymers can be, it is believed, obtained from a number of sources, such as Aldrich Chemicals and E.I. DuPont, or can be generated from suitable monomers by the polymerization thereof. The monomers selected for synthesizing the above polymers can be obtained from a number of sources, such as Aldrich Chemical Company with respect to 2-dimethylaminoethyl methacrylate, 2-diethyl aminoethyl methacrylate, methylmethacrylate, and 2-acrylamido-2-methyl-1-propane sulfonic acid; and for example, Scientific Polymer Products with regard to 2-diisopropyl aminoethyl methacrylate and 2-t-butylaminoethyl methacrylate. Synthetic methods for the preparation of polymers and copolymers from these monomers may be by bulk polymerization, solution polymerization, emulsion polymerization, suspension or semisuspension polymerization or any other known suitable polymerization methods.

The polymers selected for the carrier coatings can thus be prepared by bulk polymerization which can be accomplished with monomers in the absence of solvent, and by solution polymerization can be effected in a solvent medium, such as toluene, in which the monomer or mixture of monomers is combined with a suitable initiator, such as 2,2'-azobis(2-methylpropionitrile), referred to as AIBN, and reacted for an effective period of time, for example from about 7 to about 15, and preferably about 11 hours, at an elevated temperature, for example about 70° C. to about 90° C. From this reaction, a toluene solution of polymethyl methacrylate with a solids content of, for example, about 22.7 percent by weight polymer can be obtained, and wherein the polymer has a glass transition of about 108° C., and molecular weight by gel permeation chromatography of $M_w$=about 90,000 with molecular weight dispersibility, that is the ratio of $M_w/M_n$, or MWD=of about 2.3.

Suspension polymerization methods involve mixing monomers and initiator, such as AIBN, to obtain a clear organic phase. The organic phase is then combined with an aqueous solution of Air Products Airvol 603 polyvinyl alcohol, and a potassium iodide aqueous phase inhibitor. The desired particle size can be obtained by homogenizing the two phases with a Brinkman homogenizer equipped with a Polytron Generator with three stationary and three moving rings of flat rotor design for about five minutes at about 8,000 RPM. The resulting suspended organic phase is then transferred to the preheated reactor and stirred at about 65 RPM to maintain stability of the suspension, maintained at 70° C. for 6 hours and 40 minutes to complete polymerization, cooled, removed from the reactor, washed and centrifuged 5 times with a 90/10 volume ratio of methanol/water, and finally washed with water only. The wet polymer suspension is then air dried, placed in a vacuum oven at from about 40.0° C. to 80.0° C. to complete drying, and further broken down to its primary particle size by ball milling followed by screen sieving. This process yields a polymer particle size having a volume median of, for example, about 4 microns, a second pass glass transition onset temperature of 95.8° C., and a molecular weight $M_w$ by gel permeation chromatography of about 520,000 with an about MWD of about 2.2.

Emulsion polymerization can be accomplished by the continuous addition to a suitable reaction vessel containing water, and providing mechanical stirring, a nitrogen atmosphere, and thermostatic control, of a mixture of monomers and an initiator, such as ammonium persulfate initiator, as obtained from Aldrich Chemical Company (0.2 to 0.6 percent by weight of monomers). The polymerization can be effected by heating to, for example, between about 55° C. and about 65° C. to achieve polymer molecular weights, $M_w$ by gel permeation chromatography ranging from, for example, about 200,000 to about 900,000. The polymer or copolymer powder can be isolated by freeze drying in vacuo, the residue free latex, and the resulting polymer particle diameter size is, for example, about 0.1 to about 2.0 microns in volume average diameter.

The carrier polymer coating may have dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing step.

Also, the carrier coating can have incorporated therein various known charge enhancing additives, such as phosphate quaternary ammonium salts, quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), bisulfate silicas, cetyl pyridinium chloride (CPC), FANAL PINK® D4830, and the like, including those as may be illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of additional polymer carrier coatings selected, that is, for example, a polymer in addition to the blend of an amine polymer and a polymer containing a carboxylic acid functionality, or a sulfonic acid functionality illustrated herein, can include polyalkyl methacrylates or acrylates, styrene copolymers, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 patents mentioned herein, the disclosures of which are totally incorporated herein by reference.

A specific additional polymer in addition to the blend of an amine polymer and an additional polymer containing a carboxylic acid functionality, or a sulfonic acid functionality illustrated herein, and optionally a further polymer, is comprised of a thermosetting polymer and yet, more specifically, a poly(urethane) thermosetting resin which contains, for example, from about 75 to about 95, and preferably about 80 percent by weight of a polyester polymer, which when combined with an appropriate crosslinking agent, such as isopherone diisocyannate and initiator, such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This polymer can be mixed together with the blend of an amine polymer and an additional polymer containing a carboxylic acid functionality, or a sulfonic acid functionality, generally prior to mixing with the core, which when fused forms a uniform coating of the first and second polymers on the carrier surface. The additional polymer is present in an amount of from about 0 percent to about 99 percent, or from about 10 percent to about 75 percent by weight, based on the total weight of the first and second polymers, and the conductive component in the first polymer.

The advantages of the carriers of the present invention include in embodiments high robust carrier tribo charge of a positive value, high stable toner tribo charge of a negative value, excellent admix, for example from about 1 to about 30 seconds as determined in the charge spectrograph, increased resistance of the carrier to mechanical aging in a xerographic environment and a decreased sensitivity of the carrier triboelectric value to the relative humidity of the environment, and the like. More specifically, the toner tribo can be, for example, from about a minus 30 to about a minus 100, from about a minus 40 to about a minus 70, or from about a minus 35 to about a minus 60, with corresponding positive tribo charges for the carrier. The tribo can be determined by a number of known methods, such as the use of a Faraday Cage. With respect to high toner tribo charge of a negative value, this property is important to xerographic, especially color applications, primarily because there is enabled development of toner particles into regions of the imaging member, such as a photoreceptor, where strong fringe electrical fields exist, that is, at the borders of solids areas and lines. Developing toner particles through these fringe fields minimizes or eliminates the untoned part of the image which appears between two adjacent colors in an image.

Various effective suitable processes can be selected to apply monomer, polymer, or mixtures thereof, for example from 2 to about 5, and preferably two, of polymer coatings to the surface of the carrier particles as illustrated herein. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, preferably as powders, heating is initiated to permit flow out of the coating material over the surface of the carrier core. The concentration of the coating material powder particles, and the parameters of the heating may be selected to enable the formation of a continuous film of the coating polymers on the surface of the carrier core, or permit only selected areas of the carrier core to be coated. When selected areas of the carrier core remain uncoated or exposed, the carrier particles can possess electrically conductive properties when the core material comprises a metal. The aforementioned conductivities can include various suitable values. Generally, however, this conductivity is from about $10^{-7}$ to about $10^{-17}$ mho-$cm^{-1}$ as measured, for example, across an 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders include thermoplastic resins, which when admixed with the carrier generates developer compositions, such binders including styrene based resins, styrene acrylates, styrene methacrylates, styrene butadienes, polyamides, vinyl resins, polyesters, such as those obtained by the polymeric esterification products of a dicarboxylic acid and a diol comprising a diphenol. Specific vinyl monomers that can be selected are styrene, p-chlorostyrene, vinyl naphthalene, unsaturated mono-olefins, such as ethylene, propylene, butylene and isobutylene, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methyl alpha-chloroacrylate, methyl methacrylate, ethyl methacrylate, and butyl methacrylate; acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone, N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of dyes thereof can be selected.

When the colorant particles are comprised of magnetites, which are a mixture of iron oxides ($FeO \cdot Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of binder material is selected. In embodiments, the toner composition is comprised of from about 85 percent to about 97 percent by weight of toner resin particles, and from about 3 percent by weight to about 15 percent by weight of colorant particles such as carbon black.

For enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members can be charged negatively thus usually requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated. In the synthetic Examples, the first type polymer contains amine groups and the second type polymer contains carboxylic acid or sulfonic acid functional groups.

SYNTHETIC EXAMPLE I (A First Type Polymer)

Synthesis of a 85/15 weight percent copolymer, poly (methylmethacrylate-co-dimethylaminoethyl methacrylate) as follows:

A 2.5 liter, glass jacketed reactor was fitted with a stainless steel stirrer, thermal couple temperature probe, water cooled condenser with nitrogen outlet, and heated by a circulating hot water bath to about 75° C. The toluene and monomers were passed through a column of basic aluminum oxide to remove inhibitors and sparged with nitrogen gas to remove oxygen. The polymerization initiator 2,2'-azobis(2-methylpropionitrile), referred to as AIBN, was used as received.

To a suitable mixing vessel were added 750 grams of reagent grade toluene, 75 grams of dimethylaminoethyl methacrylate, 425 grams of methylmethacrylate, and 2 grams of AIBN. After a solution was obtained, the contents were transferred to the reactor that was preheated to maintain a 70° C.+/−1.0° C. polymerization temperature. After 5 hours of polymerization, a second addition of 0.5 gram of AIBN, dissolved in 100 grams of toluene, was accomplished. After an additional 6 hours of polymerization to complete the above monomers conversion, the polymer solution was cooled and transferred to a polymer glass storage vessel using additional toluene to rinse out the polymer solution in the reactor. After removing the solvent in vacuo, the resulting resin was found to exhibit a glass transition by DSC of 108° C. Molecular weight by gel permeation chromatography was $M_w$=90,000, $M_n$=40,000, MWD=2.3; percent nitrogen by CHN analysis was 1.31, which represents 13 percent incorporation of the amine monomer.

SYNTHETIC EXAMPLE II (A First Type Polymer)

A copolymer of 92 percent by weight of methylmethacrylate (MMA) and 8 percent of di-isopropylaminoethyl methacrylate (DMAEMA) was synthesized by an emulsion copolymerization which involved initiation and growth of copolymer latex particles by the continuous addition of the corresponding monomer mixture. Polymerization and particle growth was carried out such that a solids content of from 15 percent by weight to about 40 percent by weight was achieved. An emulsion procedure was utilized, whereby a solution of 2 grams of sodium lauryl sulfate surfactant, in 1.1 liter of distilled water, was prepared in a suitable reaction vessel, providing mechanical stirring, nitrogen atmosphere, and thermostatic control. Initiation of latex particles was accomplished by the addition of approximately 100 grams of the monomer mixture followed by addition of 1 to 2 grams of ammonium persulfate, with the temperature initially at 68° C. Rapid stirring was continued until any exotherm was completed. This was followed by a continuous and metered addition of the remaining monomer mixture at a rate of 1.0 to 2.0 grams/minute. This polymerization stage was carried out at 68° C., with heating continued for an additional 1 to 3 hours. Number median particle diameter of 0.1 micron was estimated by Brownian motion detection methods for the final latex mixture. The copolymer powder of poly(MMA-co-DIAEMA) (92 percent/8 percent monomer ratio) was isolated by freeze drying the latex. Molecular weight ($M_w$) was determined by gel permeation chromatography to be 355,000, with MWD=3.3. The copolymer glass transition temperature (Tg) by DSC analysis was determined to be 110° C.

SYNTHETIC EXAMPLE III (A First Type Polymer)

Copolymers were also prepared without added surfactant by a process referred to as "soapless" or surfactant free emulsion polymerization ("SFE") at an overall solids content of 15 to 25 weight percent. Specifically, a copolymer of 9 percent by weight diisopropylaminoethyl methacrylate (DIAEMA) with 91 percent methyl methacrylate (MMA) was prepared by dissolving 1 gram of ammonium persulfate in 1.01 liter of distilled water, in a suitable reaction vessel, providing mechanical stirring, nitrogen atmosphere, and thermostatic control. The temperature was controlled to 78° C.+/−1° C. as the monomer mixture (9 percent DIAEMA/91 percent MMA) was metered into the reaction vessel at a rate of 1.0 gram/minute. The resulting latex suspension was found to have a number median particle diameter of 0.65 to 1.3 microns, as determined by Brownian motion detection methods. Molecular weight, $M_w$, of the resulting freeze dried copolymer powder as determined by GPC methods was 93,000 with MWD=3.0. The DIAEMA incorporation in the copolymer was estimated from CHN elemental analysis to be 6 percent by weight.

SYNTHETIC EXAMPLE IV (A Second Type Polymer)

A random copolymer of methacrylic acid with methyl methacrylate was prepared by an continuous addition emulsion method as follows.

To a 3 liter glass reaction vessel provided with mechanical stirring, nitrogen atmosphere, and thermostatic control was added 1,013 grams of distilled water, and 1.9 grams of sodium lauryl sulfate surfactant. A mixture of 10 grams of methacrylic acid (as received from Aldrich Chemical) and 290 grams of methylmethacrylate was placed in a separate vessel with metering pump connected to the reaction vessel. After preheating the reactor to 65° C. to 70° C., and while stirring at 175 to 200 rpm, and adding approximately one fourth of the monomer mixture, 1.1 grams of ammonium persulfate initiator was added. Latex particle formation was observed within 30 seconds. To this latex was then added the remainder of the monomer mixture at a rate of 1.1 grams/minute, with heating at 67° C. to 68° C. continued. A fine powdered sample of copolymer product was isolated by freeze drying. Molecular weight ($M_w$) was determined by gel permeation chromatography to be 300,000, with MWD=3.8. The resulting polymer powder was determined to have a glass transition at 114° C. and number median particle diameter of 0.163 micron as estimated by Brownian motion detection of the latex emulsion.

SYNTHETIC EXAMPLE V (A Second Type Polymer)

The synthesis of the copolymer, poly (methylmethacrylate-co-2-acrylamido-2-methyl-1-propane sulfonic acid), containing 2.5 mole percent 2-acrylamido-2-methyl-1-propane sulfonic acid and 97.5 mole percent methyl methacrylate was accomplished as follows.

A 2.5 liter jacketed glass reactor was fitted with a stainless steel stirrer, thermal couple temperature probe, water cooled condenser with nitrogen outlet, a nitrogen inlet, and heated by a hot, about 75° C., water circulating bath. Toluene and methyl methacrylate were purified to remove impurities and sparged with dry nitrogen gas to remove oxygen. The polymerization initiator 2,2'-azobis(2-methylpropionitrile) referred to as AIBN and 2-acrylamido-2-methyl propane sulfonic acid, referred to as AMPS, was used as received.

To the reactor were added 518 grams of toluene, 100 grams of dry methanol, 50 grams of dry dimethyl formamide, 10 grams of AMPS, 190 grams of methyl methacrylate and 1 gram of AIBN. Heat was applied to the external jacket to raise and maintain a 61° C.+/−1° C. polymerization temperature. When complete solution was obtained, 1 gram of AIBN in 30 milliliters of toluene was added. After 6.5 hours of polymerization, a second addition of 0.5 gram of AIBN, dissolved in 30 grams of toluene, was made and held at 61° C.+/−1° C. After an additional 6.5 hours of polymerization, a third addition of 0.25 gram of AIBN, dissolved in 30 grams of toluene, was made and the mixture resulting was held at 61° C.+/−1° C. for about 7 hours to complete the monomer conversion. The polymer solution was then cooled, washed from the reactor with additional toluene, and transferred to a glass storage vessel. The final solution had a solids content of 21.6 percent.

SYNTHETIC EXAMPLE VI (A First Type Polymer)

Procedure for the synthesis of the copolymer, poly(methyl methacrylate-co-dimethylaminoethyl methacrylate), containing 10 mole percent dimethylaminoethyl methacrylate and 90 mole percent methyl methacrylate as follows.

A 2.5 liter jacketed glass reactor was fitted with a stainless steel stirrer, thermal couple temperature probe, water cooled condenser with nitrogen outlet, a nitrogen inlet, and heated with hot, about 75° C., water circulating bath. The toluene and monomers were passed through a column of basic aluminum oxide to remove inhibitors and sparged with nitrogen gas to remove oxygen. The polymerization initiator 2,2'-azobis(2-methylpropionitrile), obtained from Aldrich Chemical and referred to as AIBN, was used as received.

To a suitable mixing vessel were added 750 grams of reagent grade toluene, 75 grams (0.477 moles) of dimethylaminoethyl methacrylate, 425 grams (4.245 moles) of methylmethacrylate, and 2 grams (0.012 moles) of AIBN. After a solution was obtained, the contents were transferred to the reactor that was preheated to maintain a 70° C.+/−1° C. polymerization temperature. After 5 hours of polymerization, a second addition of 0.50 gram (0.0033 moles) of AIBN, dissolved in 100 grams of toluene, was accomplished. After an additional 6 hours of polymerization to complete the monomers conversion, the polymer solution was cooled and diluted with additional toluene before transferring to a glass storage vessel. The solids content was found to be 23 percent.

SYNTHETIC EXAMPLE VII

Coating Polymer Blends Prepared by Blending of the Latexes of a First Type Polymer and a Second Type Polymer Intimate blends of a copolymer of 90 percent by weight of methylmethacrylate (MMA) and 10 percent of dimethylaminoethyl methacrylate (DMAEMA) polymer (first type polymer) with a copolymer of 96 percent MMA and 4 percent methacrylic acid (second type polymer) were obtained by freeze drying their respective latex mixtures as follows. With gentle stirring, i.e. mechanical paint paddle type at 125 to 175 rpm, the first type polymer latex was slowly added to the second type polymer latex. Approximately 250 gram quantities of the latex mixture were then transferred to a freeze dry flask (1,200 cc. capacity), and the liquid frozen via a shell freezer, and then freeze dried to a fine white powder.

DMT Evaluation:

The powder resin blend was then evaluated by differential scanning calorimetry (DSC) and by dynamic mechanical testing (DMT) both before and after heat treatment simulating treatment anticipated during the processing/coating conditions of carrier preparation (i.e., see carrier Examples that follow, "rotating tube furnace for a period of 30 minutes between 350 and 450F"). DMT measurements were performed on a compressed disc sample of the resin blend. Limiting or zero shear modulus G' was determined from 1 percent strain at various frequencies. The $G_0'$ modulus or "zero shear rate" value was found to increase upon heat treatment at 190° C. (375° F.) by 51 percent. Upon similar treatment, an increase in glass transition temperature from 109° C. to 115° C. was also noted. These changes in properties of the polymer blend supports the conclusion that a chemical interaction between "the first type polymer" and the "second type polymer" had taken place.

SYNTHETIC EXAMPLE VIII

Coating Polymer Blends Prepared by Blending of the Dry Powders of a First Type Polymer and a Second Type Polymer Fifty grams each of the freeze dried powders of the individual DMAEMA or DIAEMA copolymer as "first type polymer" and of methacrylic acid-co-methylmethacrylate as "second type polymer" were weighed into a 32 ounce glass or stainless steel jar along with eighty (80) grams of ⅛" diameter steel shot. The container was placed on a "paint shaker" apparatus and vigorously shaken for six minutes. The resulting powder mixtures were screened and used in carrier coating preparations as illustrated in Carrier Examples II and III below.

SYNTHETIC EXAMPLE IX

Coating Prepared from a Solution Blend of a First Type Polymer and a Second Type Polymer A polymer coating solution was generated from Synthetic Example V and Synthetic Example VI. To a suitable vessel were added 50 grams of the solution of Example V, equivalent to 0.0026 moles of 2-acrylamido-2-methyl-1-propane sulfonic acid, and 11.87 grams of the solution of Synthetic Example VI, equivalent to 0.0026 moles of dimethylaminoethyl methacrylate. After thorough mixing, the solution was draw bar coated onto an aluminum substrate, air dried at room temperature for 3 hours and further dried at 50° C. to remove solvent for an additional 5 hours. The resulting polymer coated substrate was then cut in half, placing one half in an oven set at 205° C. for 8 minutes before removing and cooling to room temperature. Upon examination of the resulting polymer films, it was found that the cured film had improved scratch resistance in comparison to the uncured film. A solubility test performed on the two films found the uncured film to dissolve in about 6 minutes while the heat cured film took about 16 minutes to dissolve, indicating an increase in molecular weight due to crosslinking during heating.

CARRIER EXAMPLE I

A carrier coated with an intimate blend of a copolymer of 90 percent by weight of methylmethacrylate (MMA) and 10 percent of dimethylaminoethyl methacrylate (DMAEMA) polymer (first type polymer) and a copolymer of 96 percent MMA and 4 percent methacrylic acid (second type polymer) is prepared as follows.

In the first step of the carrier coating process, 2.9 grams of a blend of a copolymer of 90 percent by weight of methylmethacrylate (MMA) and 10 percent of dimethylaminoethyl methacrylate (DMAEMA) polymer (first type polymer) and a copolymer of 96 percent MMA and 4 percent methacrylic acid (second type polymer) prepared in Synthetic Example VII and 190 grams of 77 micron volume median diameter irregular steel core (obtained from Hoeganaes) are mixed in a 250 milliliter plastic bottle. The mixing is accomplished with a hand shaker for a period of 45 minutes. There results a uniformly distributed and electrostatically attached polymer on the core as determined by visual observation. In the second step, the mixture of core and polymers is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of 1.5 percent coating weight of polymer on the surface, the polymer being comprised of 1.35 percent coating weight of poly(methyl methacrylate-co-dimethylaminoethyl methacrylate) (90 percent/10 percent monomer ratio in the polymer) and 0.15 percent coating weight of poly(methyl methacrylate-co-methacrylic acid ) (96 percent/4 percent monomer ratio). It is believed that the dimethylamino and methacrylic acid functionalities react on the surface of the core, forming a very high molecular weight crosslinked polymer composite as a result.

A developer composition is then prepared by mixing 100 grams of the above prepared carrier with 4 grams of a 7 micron volume median diameter (volume average diameter) toner composition comprised of a pigment, 10 weight percent of carbon black, like REGAL 330® and 90 weight percent of a partially crosslinked polyester resin with 7 percent (by weight) gel content, obtained by the reactive extrusion of a linear bisphenol A propylene oxide fumarate polymer. This developer is conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles is determined by the known Faraday Cage process. The triboelectric charge on the carrier particles is anticipated to be between 40 and 70 microcoulombs per gram of toner, and substantially independent of developer mixing time. Further, the conductivity of the carrier is determined by forming a 0.1 inch long magnetic brush of the carrier particles, and measuring the conductivity by imposing a 10 volt potential across the brush is anticipated to be between $1.0\times10^{-12}$ (mho-cm)$^{-1}$ and $1.0\times10^{-14}$ (mho-cm)$^{-1}$. Therefore, these carrier particles are insulative.

CARRIER EXAMPLE II

A carrier coated with a dry powder mixed blend of a copolymer of 90 percent by weight of methylmethacrylate (MMA) and 10 percent of dimethylaminoethyl methacrylate (DMAEMA) polymer (first type polymer), and a copolymer of 96 percent MMA and 4 percent methacrylic acid (second type polymer) is prepared as follows.

In the first step of the carrier coating process, 2.9 grams of the dry powder mixed blend of a copolymer of 90 percent by weight of methylmethacrylate (MMA) and 10 percent of dimethylaminoethyl methacrylate (DMAEMA) polymer (first type polymer) and a copolymer of 96 percent MMA and 4 percent methacrylic acid (second type polymer) prepared in Synthetic Example VIII and 190 grams of 77 micron volume median diameter irregular steel core (obtained from Hoeganaes) are mixed in a 250 milliliter plastic bottle. The mixing is accomplished with a hand shaker for a period of 45 minutes. There results a uniformly distributed and electrostatically attached polymer on the core as determined by visual observation. The second step of the coating process is substantially identical to that of Carrier Example I. The final product is comprised of a carrier core with a total of 1.5 percent coating weight of polymer on the surface, the polymer being comprised of a 1.35 percent coating weight of poly(methyl methacrylate-co-dimethylaminoethyl methacrylate) (90 percent/10 percent monomer ratio in the polymer) and 0.15 percent coating weight of poly(methyl methacrylate-co-methacrylic acid) (96 percent/4 percent monomer ratio). It is believed that the dimethylamino and methacrylic acid functionalities react on the surface of the core, forming a very high molecular weight crosslinked polymer composite as a result.

A developer composition is then prepared by mixing 100 grams of the above prepared carrier with 4 grams of a 7 micron volume median diameter (volume average diameter) toner composition identical to that of Carrier Example I. This developer is conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles is determined by the known Faraday Cage process. The triboelectric charge on the carrier particles is anticipated to be between 40 and 70 microcoulombs per gram of toner, and substantially independent of developer mixing time. Further, the conductivity of the carrier is determined by forming a 0.1 inch long magnetic brush of the carrier particles, and measuring the conductivity by imposing a 10 volt potential across the brush is anticipated to be between $1.0\times10^{-12}$ (mho-cm)$^{-1}$ and $1.0\times10^{-14}$ (mho-cm)$^{-1}$. Therefore, these carrier particles are insulative.

CARRIER EXAMPLE III

A carrier coated with a dry powder mixed blend of a copolymer of 90 percent by weight of methylmethacrylate (MMA) and 10 percent of diisopropylaminoethyl methacrylate (DIAEMA) polymer (first type polymer) and a copolymer of 96 percent MMA and 4 percent methacrylic acid (second type polymer) is prepared as follows.

In the first step of the carrier coating process, 2.9 grams of the dry powder mixed blend of a copolymer of 90 percent by weight of methylmethacrylate (MMA) and 10 percent of diisopropylaminoethyl methacrylate (DIAEMA) polymer (first type polymer) and a copolymer of 96 percent MMA and 4 percent methacrylic acid (second type polymer) prepared in Synthetic Example VIII and 190 grams of 77 micron volume median diameter irregular steel core (obtained from Hoeganaes) are mixed in a 250 milliliter plastic bottle. The mixing is accomplished with a hand shaker for a period of 45 minutes. There results a uniformly distributed and electrostatically attached polymer on the core as determined by visual observation. The second step of the coating process is substantially identical to that of Carrier Example I. The final product is comprised of a carrier core with a total of 1.5 percent coating weight of polymer on the surface, the polymer being comprised of a 1.35 percent coating weight of poly(methyl methacrylate-co-diisopropylaminoethyl methacrylate) (90 percent/10 percent monomer ratio in the polymer) and 0.15 percent coating weight of poly(methyl methacrylate-co-methacrylic acid) (96 percent/4 percent monomer ratio). It is believed that the diisopropylamino and methacrylic acid functionalities react on the surface of the core, forming a very high molecular weight crosslinked polymer composite as a result.

A developer composition is then prepared by mixing 100 grams of the above prepared carrier with 4 grams of a 7 micron volume median diameter (volume average diameter) toner composition identical to that of Carrier Example I. This developer is conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles is determined by the known Faraday Cage process. The triboelectric charge on the carrier particles is believed to be between 40 and 70 microcoulombs per gram of toner, substantially independent of developer mixing time. Further, the conductivity of the carrier is determined by forming a 0.1 inch long magnetic brush of the carrier particles, and measuring the conductivity by imposing a 10 volt potential across the brush is anticipated to be between $1.0\times10^{-12}$ (mho-cm)$^{-1}$ and $1.0\times10^{-14}$ (mho-cm)$^{-1}$. Therefore, these carrier particles are insulative.

CARRIER EXAMPLE IV

A carrier coated with a mixed blend of a copolymer of 90 percent by weight of methylmethacrylate (MMA) and 10 percent of dimethylaminoethyl methacrylate (DMAEMA) polymer (first type polymer) and a copolymer of poly (methylmethacrylate-co-2-acrylamido-2-methyl-1-propane sulfonic acid) (second type polymer) is prepared as follows.

In the first step of the solution coating process, 22.7 grams of a solution prepared in Synthetic Example IX by adding 50 grams of the solution of Example V, equivalent to 0.0026 mole of 2-acrylamido-2-methyl-1-propane sulfonic acid, and 11.87 grams of solution of Synthetic Example VI, equivalent to 0.0026 moles of dimethylaminoethyl methacrylate, is roll milled until the polymers are adequately mixed. The solids concentration is 20 percent by weight. The dissolved polymer in the solvent is known as the "lacquer". In the second step of the solution coating process, 2,270 grams of a 77 micron volume median diameter irregular steel core (obtained from Hoeganaes) is added to a Vibratub and heated by a heat gun to 176° F. The Vibratub is turned on to begin vibration. The lacquer is then slowly added to the hot core and the solvent flashes off. The core and lacquer is agitated by the vibration from the Vibratub as well as by use of spatulas and other tools to help agitate the material to drive off the residual solvent. The product is then spread out on an aluminum tray and vacuum dried for several hours. The product is then screened through an 84 TBC (Tensile Bolt Cloth) mesh screen to remove any large agglomerates. The final product is comprised of a carrier core with a total of 1 percent coating weight of polymer on the surface, the polymer coating being comprised of a 0.81 percent coating weight of poly(methyl methacrylate-co-dimethylaminoethyl methacrylate) (90 percent/10 percent monomer ratio in the polymer) and 0.19 percent coating weight of poly (methylmethacrylate-co-2-acrylamido-2-methyl-1-propane sulfonic acid). It is believed that the dimethylamino and sulfonic acid functionalities react on the surface of the core forming a very high molecular weight crosslinked polymer composite as a result.

A developer composition is then prepared by mixing 100 grams of the above prepared carrier with 4 grams of a 7 micron volume median diameter (volume average diameter) toner composition identical to that of Carrier Example I. This developer is conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles is determined by the known Faraday Cage process. The triboelectric charge on the carrier particles is believed to be between 40 and 70 microcoulombs per gram of toner, substantially independent of developer mixing time. Further, the conductivity of the carrier, which is determined by forming a 0.1 inch long magnetic brush of the carrier particles, and measuring the conductivity by imposing a 10 volt potential across the brush, is believed to be between $1.0\times10^{-12}$ (mho-cm)$^{-1}$ and $1.0\times10^{-14}$ (mho-cm)$^{-1}$. Therefore, these carrier particles are insulative.

Other modifications of the present invention may occur to those of ordinary skill in the art subsequent to a review of the present application, and these modifications, including equivalents thereof, are intended to be included within the scope of the present invention.

What is claimed is:

1. A carrier comprised of a core and thereover a polymer generated from (1) a polymer containing amine groups, and (2) a second polymer containing sulfonic functional groups.

2. A carrier in accordance with claim 1 wherein said amine polymer is generated from a monoalkylamino methacrylate or a dialkylaminoalkyl methacrylate.

3. A carrier in accordance with claim 2 wherein each of said alkyls contain from 1 to about 25 carbon atoms.

4. A carrier in accordance with claim 2 wherein each of said alkyls contain from 1 to about 6 carbon atoms.

5. A carrier in accordance with claim 2 wherein said methacrylate is a dialkylaminoalkyl methacrylate.

6. A carrier in accordance with claim 5 wherein said methacrylate is 2-dimethylaminoethyl methacrylate, 2-diethylaminoethyl methacrylate, 2-diisopropylaminoethyl methacrylate, or 2-tertiary butylaminoethyl methacrylate.

7. A carrier in accordance with claim 1 wherein said second polymer is generated from alkylene sulfonic acid, styrene sulfonic acid, sulfoalkyl methacrylate, or acrylamidoalkylpropane sulfonic acid.

8. A carrier in accordance with claim 1 wherein said second polymer is generated from ethylene sulfonic acid, 2-sulfoethyl methacrylate, or 2-acrylamindo-2-methyl 1-propanesulfonic acid.

9. A carrier in accordance with claim 1 wherein there is generated a blend of said amine polymer and said second polymer, and wherein there results from said blend a crosslinked polymer.

10. A carrier in accordance with claim 1 wherein there is generated a polymer containing from about 60 to about 95 percent of said amine polymer, and from about 5 to about 40 percent by weight of said second polymer.

11. A carrier in accordance with claim 1 wherein the generated polymer possesses an $M_w$ of from about 10,000 to about 900,000, and of an $M_n$ of from about 4,000 to about 350,000.

12. A carrier in accordance with claim 1 wherein the generated polymer is a blend of polymers, and the coating weight thereof is from about 0.1 to about 20 weight percent.

13. A carrier in accordance with claim 1 wherein the generated polymer coating weight is from about 1 to about 3 weight percent.

14. A carrier in accordance with claim 1 wherein the generated polymer contains a conductive component.

15. A carrier in accordance with claim 14 wherein said conductive component is a metal oxide, or is carbon black.

16. A carrier in accordance with claim 15 wherein said conductive component is carbon black selected in an amount of from about 10 to about 60 weight percent.

17. A carrier in accordance with claim 1 wherein said core is a metal, a metal oxide, or a ferrite.

18. A carrier in accordance with claim 1 with a triboelectric charge of from about a positive 35 to about a positive 100 microcoulombs per gram.

19. A developer comprised of the carrier of claim 1 and toner.

20. A developer in accordance with claim 19 wherein the toner is comprised of thermoplastic resin and colorant.

21. A developer in accordance with claim 20 wherein the colorant is a pigment, and the resin is a styrene copolymer or a polyester.

22. A developer comprised of a (1) carrier core, and thereover a coating of a polymer or polymers generated from a mixture of an amine polymer and a second polymer containing sulfonic acid functional groups, or a sulfonic acid functional group.

23. A developer in accordance with claim 22 wherein the carrier core is selected from the group consisting of iron, ferrites, steel and nickel.

24. A developer in accordance with claim 22 with a carrier triboelectric charge of from about a positive 30 to about a positive 100 microcoulombs per gram, and a toner triboelectric charge of from about a negative 30 to about a negative 100 microcoulombs per gram.

25. A carrier in accordance with claim 1 wherein said generated polymer is a copolymer generated from the reaction of said amine polymer and said second polymer.

26. A carrier in accordance with claim 25 wherein said copolymer is polymethyl methacrylate-co-dimethyl aminoethyl methacrylate and polymethyl methacrylate-co-ethylene sulfonic acid; polymethyl methacrylate-co-dimethyl aminoethyl methacrylate and polymethyl methacrylate-co-2-sulfoethyl methacrylate; polymethyl methacrylate-co-dimethyl aminoethyl methacrylate and polymethyl methacrylate-co-styrene sulfonic acid; polymethyl methacrylate-co-dimethyl aminoethyl methacrylate and polymethyl methacrylate-co-2-acrylamido-2-methyl-1-propanesulfonic acid; polymethyl methacrylate-co-2-diisopropylaminoethyl methacrylate and polymethyl methacrylate-co-2-sulfoethyl methacrylate; and polystyrene-co-dimethyl aminoethyl methacrylate and polymethyl methacrylate-co-2-sulfoethyl methacrylate.

27. A carrier in accordance with claim 1 wherein said generated polymer coating possesses an $M_w$ of from about 15,000 to about 500,000 and an $M_n$ of from about 7,000 to about 225,000, said polymer coating resulting from said amine polymer and said second polymer.

28. A carrier in accordance with claim 1 wherein the carrier contains an additional polymer coating.

29. A carrier in accordance with claim 28 wherein the additional coating is comprised of a styrene acrylate, a styrene methacrylate, methyl methacrylate or a fluoropolymer.

30. A carrier in accordance with claim 28 wherein said additional coating is comprised of a polyurethane, and which polyurethane optionally contains dispersed therein conductive components.

31. A carrier in accordance with claim 28 wherein the additional coating is comprised of a polyurethane/polyester with carbon black optionally dispersed therein.

32. A carrier in accordance with claim 2 wherein said substituted alkyl aminoethyl methacrylate is 2-tertiarybutylaminoethyl methacrylate, or dimethylaminoethyl methacrylate (TRH).

33. An imaging process which comprises developing an image with the developer of claim 19.

34. A process for the preparation of the carrier of claim 1 by the dry mixing and heating of said core and said generated polymer coating.

35. A carrier comprised of a core and a (1) polymer coating, which coating is formed from an amine containing polymer and a polymer containing a sulfonic acid functionality; and (2) an optional additional polymer of a polyurethane/polyester.

36. A carrier in accordance with claim 35 wherein said (1) polymer is formed by the reaction of said amine and said sulfonic acid polymer.

37. A carrier in accordance with claim 1 wherein said core is strontium ferrite.

38. A carrier in accordance with claim 1 wherein said generated polymer is formed by the reaction of (1) and (2).

39. A carrier in accordance with claim 38 wherein said reaction is accomplished by heating.

40. A carrier comprised of a core and a coating thereover of a polymer comprised of the reaction product of an amine containing polymer and a sulfonic containing polymer.

41. A carrier consisting essentially of a core and thereover a polymer generated from (1) a polymer containing amine groups, and (2) a second polymer containing sulfonic functional groups.

42. A carrier comprised of a core and thereover a polymer generated from (1) a polymer containing amine groups, and (2) a second polymer containing sulfonic functional groups, and wherein said generated polymer is a copolymer, and wherein said copolymer is polymethyl methacrylate-co-dimethyl aminoethyl methacrylate and polymethyl methacrylate-co-ethylene sulfonic acid; polymethyl methacrylate-co-dimethyl aminoethyl methacrylate and polymethyl methacrylate-co-2-sulfoethyl methacrylate; polymethyl methacrylate-co-dimethyl aminoethyl methacrylate and polymethyl methacrylate-co-styrene sulfonic acid; polymethyl methacrylate-co-dimethyl aminoethyl methacrylate and polymethyl methacrylate-co-2-acrylamido-2-methyl-1-propanesulfonic acid; polymethyl methacrylate-co-2-diisopropylaminoethyl methacrylate and polymethyl methacrylate-co-2-sulfoethyl methacrylate; and polystyrene-co-dimethyl aminoethyl methacrylate and polymethyl methacrylate-co-2-sulfoethyl methacrylate.

* * * * *